US009867508B2

(12) United States Patent
Weinberg

(10) Patent No.: US 9,867,508 B2
(45) Date of Patent: Jan. 16, 2018

(54) LOOFAH

(71) Applicant: XAMAX INDUSTRIES, INC., Seymour, CT (US)

(72) Inventor: Martin Weinberg, New Canaan, CT (US)

(73) Assignee: XAMAX INDUSTRIES, INC., Seymour, CT (US)

( * ) Notice: Subject to any disclaimer, the term of this patent is extended or adjusted under 35 U.S.C. 154(b) by 0 days.

(21) Appl. No.: 15/369,634

(22) Filed: Dec. 5, 2016

(65) Prior Publication Data

US 2017/0156551 A1 Jun. 8, 2017

Related U.S. Application Data

(60) Provisional application No. 62/262,797, filed on Dec. 3, 2015.

(51) Int. Cl.

| | |
|---|---|
| ***A47K 7/02*** | (2006.01) |
| ***A47L 13/16*** | (2006.01) |
| ***A47K 7/03*** | (2006.01) |

(52) U.S. Cl.

CPC ..... *A47K 7/03* (2013.01)

(58) Field of Classification Search

CPC ..... A47K 7/03; B32B 5/022; A47L 13/17; D04H 1/425

See application file for complete search history.

(56) References Cited

U.S. PATENT DOCUMENTS

| | | | | |
|---|---|---|---|---|
| 4,832,852 | A | 5/1989 | Wells et al. | |
| 5,813,080 | A | 9/1998 | Hendren | |
| 6,737,114 | B2 | 5/2004 | Dawson, Jr. et al. | |
| 7,105,716 | B2 | 9/2006 | Baratian et al. | |
| 7,127,771 | B2 | 10/2006 | McDevitt et al. | |
| 7,741,263 | B2 * | 6/2010 | Kilkenny | A01N 33/12 134/42 |
| 2003/0217516 | A1 | 11/2003 | Smith | |
| 2006/0141014 | A1 | 6/2006 | Eknoian et al. | |
| 2007/0000082 | A1 * | 1/2007 | Picard | D04H 1/425 15/209.1 |
| 2007/0283516 | A1 | 12/2007 | Rasmussen et al. | |
| 2008/0075748 | A1 | 3/2008 | Hasenoehrl et al. | |
| 2011/0262504 | A1 | 10/2011 | Deleersnyder et al. | |
| 2011/0302733 | A1 | 12/2011 | Yuan | |
| 2012/0227203 | A1 * | 9/2012 | Ouellette | B32B 5/022 15/209.1 |

FOREIGN PATENT DOCUMENTS

| | | | |
|---|---|---|---|
| CN | 102787504 | A | 11/2012 |
| EP | 1676512 | A2 | 7/2006 |
| JP | 2004209715 | A | 7/2004 |

(Continued)

OTHER PUBLICATIONS http://www.truthaboutthreadcount.com/pure-linen.html.*

(Continued)

*Primary Examiner* — Shay Karls

(74) *Attorney, Agent, or Firm* — Baker & McKenzie LLP

(57) ABSTRACT

A loofah includes an inner core and an outer portion. The inner core includes a natural material. The outer portion includes a natural material. A water absorbency of the inner core is less than a water absorbency of the outer portion.

25 Claims, 2 Drawing Sheets

(56) References Cited

FOREIGN PATENT DOCUMENTS

| | | | |
|---|---|---|---|
| WO | 03103626 | A1 | 12/2003 |
| WO | 2007122594 | A2 | 11/2007 |
| WO | 2008015641 | A2 | 2/2008 |

OTHER PUBLICATIONS

International Search Report issued in corresponding PCT Application No. PCT/US2011/040016, dated Aug. 29, 2011, 4 pages.
Office Action issued in corresponding European Application No. 11727085, dated Feb. 23, 2016, 5 pages.
Notice of Allowance issued in corresponding U.S. Appl. No. 13/158,065, dated Aug. 14, 2014, 8 pages.
Office Action issued in corresponding U.S. Appl. No. 13/158,065, dated Mar. 6, 2014, 7 pages.
Office Action issued in corresponding U.S. Appl. No. 13/158,065, dated Jun. 6, 2013, 10 pages.
Office Action issued in corresponding U.S. Appl. No. 13/158,065, dated Sep. 4, 2012, 8 pages.
Office Action issued in corresponding U.S. Appl. No. 13/158,065, dated Mar. 29, 2012, 6 pages.
Office Action issued in corresponding U.S. Appl. No. 14/330,741, dated Oct. 13, 2016, 8 pages.
Office Action issued in corresponding U.S. Appl. No. 15/061,550, dated Nov. 18, 2016, 12 pages.
Office Action issued in corresponding U.S. Appl. No. 15/061,550, dated Jun. 2, 2016, 8 pages.
Sheila Sacks Designs, "Growing Loofahs," http://www.sheilasacksdesigns.com/loofahs/, 6 pages.
Kate Bratskeir, "You Should Probably Stop Using a Loofah in the Shower. Sorry.," http://www.huffingtonpost.com/2014/07/29/loofal-clean-health_n_5613734.html, The Huffington Post, Jul. 29, 2014, 7 pages.
Vineeta Hospitality, "Loofah Product Series," http://www.vineetaoverseas.com/products/bathroom/loofah/index.html, 2 pages.
Wikihow, "How to Use a Loofah: 9 Steps (with Pictures)," http://www.wikihow.com/Use-a-Loofah, 3 pages.
Edward J. Bottone, et al., "Loofah Sponges as Reservoirs and Vehicles in the Transmission of Potentially Pathogenic Bacterial Species to Human Skin," Journal of Clinical Microbiology, American Society for Microbiology, Feb. 1994, pp. 469-472, vol. 32, No. 2, Clinical Microbiology Laboratories, The Mount Sinai Hospital, New York, New York.
Lily Feinn, "Loofahs Have More Bacteria Than You Think—In Fact, You Should Probably Throw Yours Out," https://www.bustle.com/articles/185507-loofahs-have-more-bacteria-than-you-think-in-fact-you-should-probably-throw-yours-out, 3 pages.
Vicky Chandler, "Bad News: Your Shower Loofah Is Way More Gross Than You Think," Good Housekeeping, http://www.goodhousekeeping.com/health/news/a40645/shower-loofah-bacteria/, Sep. 28, 2016, 2 pages.
An International Search Report and the Written Opinion of the International Searching Authority dated Mar. 22, 2017 in connection with International Application No. PCT/US2016/065020.

* cited by examiner

LOOFAH

CROSS-REFERENCE TO RELATED APPLICATION

This application claims priority to U.S. Provisional Application No. 62/262,797, filed on Dec. 3, 2015, the disclosure of which is incorporated herein by its entirety.

BACKGROUND

Generally speaking, a loofah is a handheld device used to stimulate and exfoliate human skin, which may be usually used in a shower or bath and may usually be moistened with water and possibly soaps or lotions. A loofa is preferably thick enough to have a feeling of body in the hand, especially when wet. When wet, it preferably maintains its structural integrity. A loofah may be made from materials such as plastics or the body of a type of cucumber intended for repetitive, frequent use.

A loofah may become soiled with contaminants such as skin dirt, body oils and makeup, after few uses. The warm water environment where loofahs are commonly used encourages the growth of molds after a few uses. The cost of available full size loofahs ranges from about $5 to $20 each, which leads to a high cost per use if the loofah is discarded due to the above issues. Surveys have found that a loofah is used less than five times on average before being discarded. In a commercial environment, such as a hotel or spa where a single use is necessary, available loofahs are very expensive on a per use basis.

A product that allows for uses at a low cost per use would be desirable.

BRIEF SUMMARY

The present disclosure generally relates to a cotton loofah and, in particular, a cotton exfoliating loofah.

In an example, a loofah includes an inner core and an outer portion. The inner core includes a natural material. The outer portion includes a natural material. A water absorbency of the inner core is less than a water absorbency of the outer portion.

In another example, a loofah includes a first outer layer, a second outer layer, and an inner layer. A majority of a material of the first outer layer is cotton. A majority of a material of the second outer layer is cotton. The inner layer is disposed between the first outer layer and the second outer layer. A majority of a material of the inner layer is cotton. A water absorbency of the material of the inner layer is less than a water absorbency of the material of the first outer layer. The water absorbency of the material of the inner layer is less than a water absorbency of the material of the second outer layer.

In still another example, a method of manufacturing a loofah includes: providing a first sheet of non-woven cotton; depositing unbleached cotton onto the first sheet of non-woven cotton; providing a second sheet of non-woven cotton at a side of the unbleached cotton distal to the first sheet of non-woven cotton; and entangling the first sheet of non-woven cotton, the unbleached cotton, and the second sheet of non-woven cotton.

BRIEF DESCRIPTION OF THE DRAWINGS

Reference is now made to the following descriptions taken in conjunction with the accompanying drawings.

DETAILED DESCRIPTION

Various embodiments of a loofah are described according to the present disclosure. It is to be understood, however, that the following explanation is merely exemplary in describing the devices and methods of the present disclosure. Accordingly, several modifications, changes, and substitutions are contemplated. For example, although the present disclosure mainly describes a cotton loofah, the disclosed principals may be applied to other personal wipe products. Other materials, both natural and processed, may also be used.

Known natural loofah products are derived from vegetable gourds of the cucumber family. E. Bottone, *Loofah Sponges are Reservoirs and Vehicles in the Transmission of Potentially Pathogenic Bacterial Species to the Human Skin*, Journal of Clinical Microbiology, February 1994, p. 469. The hydration of dry loofah sponges even with sterile distilled water liberates bacteria embedded in the fibrous matrix of the loofah sponge. Bottone at 471. Bottone found a number of harmful bacteria in the natural loofah sponge promoted by the manufacturing process of the loofah sponges, which as soaked in water for several days to move the gourd skin and seeds. Id.

The present inventor has discovered that cotton, when prepared according to the present disclosure, can be used to create a loofah type product with a good feel and performance that does not suffer from the bacteriological deficiencies described above that arise from the fibrous matrix of a vegetable gourd. Also, when the disclosed loofah type product is used as a single use product, the opportunity to incubate bacteria is limited or avoided.

Figure 1:
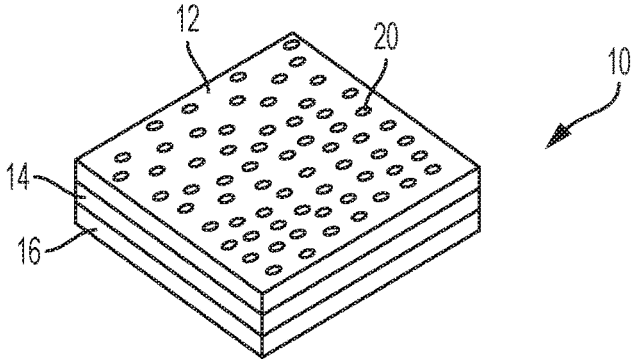
FIG. 1 is a perspective view of an exemplary loofah.
Figure 2:
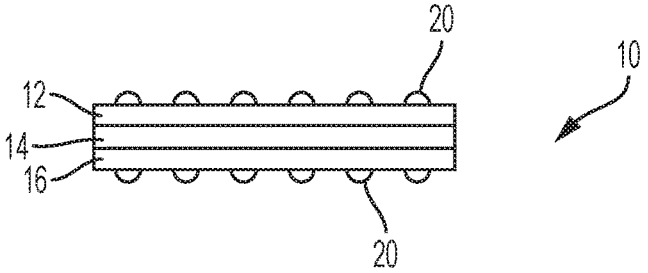
FIG. 2 is a side view of an exemplary loofah.
Figure 3:
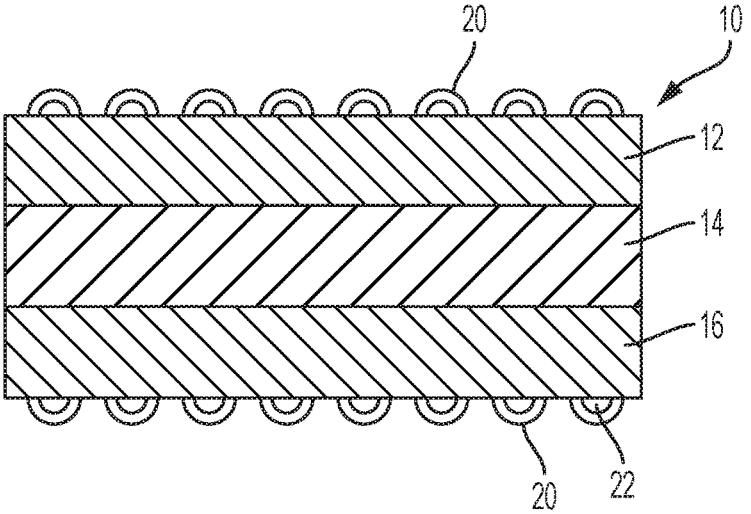
FIG. 3 is a cross-sectional view of an exemplary loofah.

FIG. 1 is a perspective view of an exemplary cotton loofah. FIG. 2 is a side view of an exemplary cotton loofah. FIG. 3 is a cross-sectional view of an exemplary cotton loofah.

Referring to FIGS. 1-3, the exemplary cotton loofah 10 includes a first outer layer 12, an intermediate layer 14 and a second outer layer 16. Each of the layers 12, 14 and 16 are preferably 100% cotton or a mostly cotton process. The use of 100% or mostly cotton for the exterior and interior of a personal wipe is preferable. Today's consumer of beauty care products is sensitive to the life cycle of products. They wish to know that the product comes from a renewable source, and the "harvesting" of this source is "kind" to the environment. The processing of cotton product used in the loofah 10 may be minimal and not requiring or adding harmful ingredients to the cotton. The product looks and "feels" natural and luxurious, and simply and effectively works for their use. The disposal of a cotton based product may also be environmentally "friendly" in the consumer's eyes.

It will be appreciated that while this discussion s provided in the context of a loofah type product, the disclosure is not limited to a loofah. For example, there are other applications where a disposable high quality alternative personal wipe is desirable.

For example, in the removal of a treatment mask such as a clay mask, a cloth may typically be used as a disposable wipe has not previously had the hand feel, size, robustness, surface abrasion (ability to grab and hold the mask chemistry). The cloth then must be laundered or discarded. The removal of makeup is made easier with the disclosed cotton product compared to more flimsy light wipes while also being more economical than cloths/towels that are high cost and/or need to be laundered.

The use of 100% or mostly cotton for the exterior and interior of a personal wipe is highly desirable. Today's consumer of beauty care products is sensitive to the life cycle of products. They wish to know that the product comes from a renewable source, and the "harvesting" of this source is "kind" to the environment. The processing of this product is minimal and does not add harmful ingredients. The product looks and "feels" natural and luxurious, and simply and effectively works for their use. The disposal needs to be environmentally "friendly" in their eyes.

There is a need for a product that allows for uses at a low cost per use. This is particularly advantageous in applications where a single or minimal number of uses are expected. Preferably, the loofah holds moisture and maintains integrity when wet.

As an example, a 100% or mostly cotton product may be made using a needling or hydro entangled process that preferably has a total weight between 5 to 10 oz/sy.

The first outer layer 12 and the second outer layer 16 (e.g., outer exfoliating layer(s)) may be made of grade of cotton that is cleaned, scoured (for example, using a solution containing sodium hydroxide), and in some cases may also be bleached. After scouring, the cotton fiber is absorbent and cleaned. The degree of absorbency of the cotton fiber may vary after it has been processed (e.g., cleaned, scoured or bleached). That it has some absorbency means that it is a hydrophilic-type material. Cotton, particularly processed cotton, has a natural affinity for oil making it particularly advantageous when provided as an outer surface of a personal wipe such as the cotton loofah 10 as it may be very effective as a skin oil blotter.

The scoured cotton may then be manufactured into a non-woven material, for example by hydroentanglement. The first layer 12 and 16 may be provided as non-woven sheet material that is thin and lightweight, for example, 1 oz/sy respectively. It will be appreciated that the cotton fibers of the first outer layer 12 and the second outer layer 16 are not required to be pre-manufactured in a non-woven material and may also be provided in a bulk form.

The intermediate layer 14 is preferably less absorptive than the first outer layer 12 and the second outer layer 16. The bleaching and cleaning process described above with respect to the first outer layer 12 and the second outer layer 16 removes the natural oils of the cotton. An example of the material (which may be referred to as a core material) for the intermediate layer 14 is unbleached, or unprocessed, or raw cotton. A core material (e.g., cotton) that has not had its natural oils removed has a coating of natural waxes that protect it from rain, which ultimately makes it a hydrophobic-type product (water repellent). This means raw cotton is usually unsuitable for use in many consumer products that require absorbency, a trait that is considered critical in most cotton applications. Raw cotton absorbs less water than had the natural oils been removed. For example, the core material may be hydrophobic (e.g., would not adsorb water). Raw cotton has the additional advantage that it is less expensive than processed cotton, making the loofah 10 more economical.

The core material may be provided as bulk, hydroentangled or needled cotton, may have a weight of 3 to 6 oz/sy, and may be made from a grade of cotton that has not had its natural oils removed.

The inventor has discovered that raw cotton, which had generally been considered undesirable for a personal wipe product, works particularly well for the inner portion of loofah type product. This may allow the assembled cotton loofah 10 to have an absorbent surface (for example, to hold cleaners or absorb materials being removed from a face like makeup or a mask) yet not absorb large amounts of water. This may provide a product that does not "ball up" when soaked with water. An exemplary additional advantage is that unprocessed cotton is lower in cost as well as more "natural." Thus, the assembled cotton loofah 10 may be much less expensive to produce as well as having a lower environmental impact though the reduced use of caustic chemicals. The savings in cost by using raw cotton for the intermediate layer 14 is significant as, preferably, 50-75% of the cotton by weight in the loofah 10 is the core material. The cost to the consumer for the assembled cotton loofah 10 may be a small fraction of the cost of available alternatives.

The first outer layer 12, the intermediate layer 14 and the second outer layer 16 of the loofah 10 may be coupled together by a needling or hydro entangling process, which may provide an efficient method of incorporating the exfoliating layers(s) (e.g., the first outer layer 12 and the second outer layer 16 discussed in more detail below) with the core cotton product (e.g., the intermediate layer 14) while not requiring adhesives or bonding agents. The combination of bonding the exfoliating layer(s) while needling or hydro entangling the core cotton product may also provide significant economy.

In an embodiment, the material of the intermediate layer 14 may be treated with a binder agent, which may stiffen the intermediate layer. An example of a stiffening binder agent is Dur-O-Set® C-310 Emulsion made by Celanese Corporation. It is a water-based polyvinyl acetate emulsion that imparts rigidity and stiffness. Another example of a stiffening binder agent is Resyn® 1601 Emulsion made by Celanese Corporation. It is a water-based polyvinyl acetate emulsion stabilized with polyvinyl alcohol that will also impart rigidity and stiffness.

The inventor has discovered that stiffening the intermediate layer 14 is particularly advantageous for a loofah-type product as it may approximate the stiffer feel of the natural gourd type loofah or the synthetic material loofah while retaining the softer cotton touch on the skin of the consumer. The binder may also increase the hydrophobic properties of the core material. This combination of an overall stiffer loofah 10 while retaining a softer outer surface provides an experience that the inventor has determined to be more preferred by the consumer.

In an embodiment, one or two surfaces of the loofah 10 may have an outer surface that includes exfoliating materials or exfoliating properties. For example, the first outer layer 12 and/or the second outer layer 16 may include a textured cotton material provided by applying a patterned coating to the sheet. The patterned coating may include the beads 20 adhered to the outer surface of the first outer layer 12 and/or the second outer layer 16.

Each bead 20 is formed to have a three dimensional geometry that extends outwardly from the surface of the outer layer. The beads may improve the abrasive qualities of the loofah 10. This may offer advantages such as improved scrubbing performance of the loofah. As will be discussed further below, the beads may be made of materials that are not as water soluble as the first outer layer 12 and the second outer layer 16. Thus, the performance of the loofah while wet may be further improved. It will be appreciated that the term "bead" is not limiting and refers to a variety of different protrusions.

The beads 20 may also include materials including abrasive particles and/or acrylic resin(s). An example of an exfoliating agent is abrasive particles included in the coating that can provide a selectively abrasive surface. The specific type, size, and density of abrasive particles within the coating can be varied to suit the application at hand.

In a preferred example, each bead 20 includes a puffing agent. The composition that forms the bead 20 may also include an appropriate binding agent such as an acrylic emulsion that enhances the adherence of the composition, including the puffing agent, to the cotton wipe sheet 12. When a puffing agent is exposed to an elevated temperature (e.g., elevated over ambient) it expands (for example, by releasing a gas) to at least in part create the three dimensional shapes of the beads 20. With reference to the cross-section of FIG. 3, the puffing agent leads to an air space 22 in an interior portion of the beads 20. While an exfoliating product is desirable, if the beads 20 are too abrasive, the consumer may have a less desirable experience. The inventor has determined that the use of a puffing agent in the beads 20 is particularly advantageous as it leads to a more favorable feel to the loofah 10, which, as discussed above, may include a binder to stiffen the intermediate layer 14, the inventor has determined that.

In a second example, the beads 20 include a thermoplastic material. Examples of acceptable thermoplastic plastics include, but are not limited to, one or more of polypropylene ("PP"), polyethylene ("PE"), acrylonitrile butadiene styrene ("ABS"), polyamide ("PA"; also referred to as "Nylon"), polyethylene terephthalate ("PET"), polyvinyl chloride ("PVC") or copolymers thereof.

It will be appreciated that the outer surfaces of the first outer layer 12 and the second outer layer 16 may be provided with two different levels of abrasion, for example, by using different abrasive additives in the beads 20 or by differences in the geometry of the beads 20. The degree of abrasion of the outer surfaces of the first outer layer 12 and the second outer layer 16 may be identified by including different colors of the surfaces. For example, the beads 20 may be colored or the first outer layer 12 and/or the second outer layer 16 may be died and/or include a printed surface. Different levels of abrasion may be useful for facial vs body use.

Figure 4:
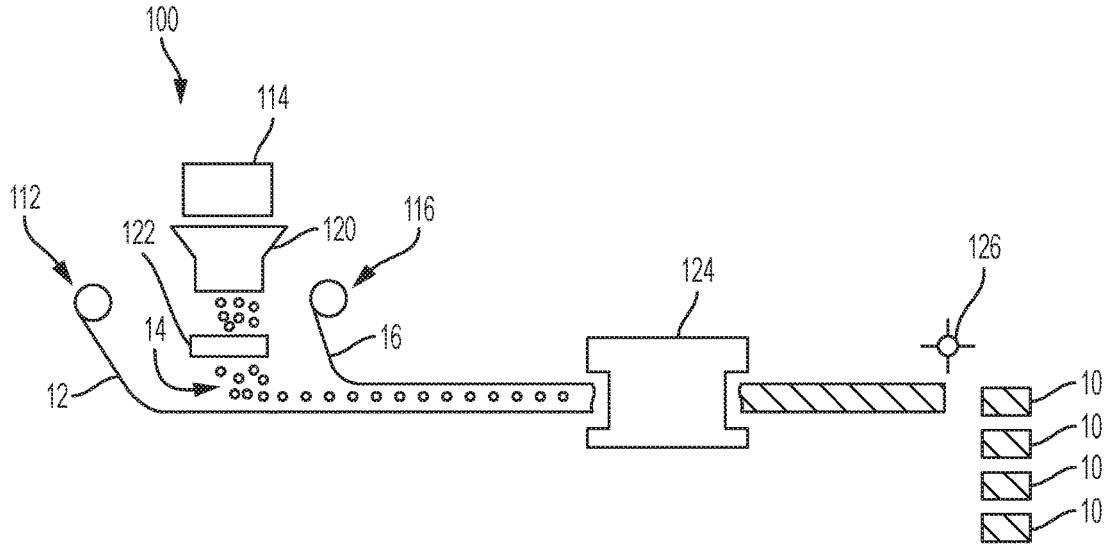
FIG. 4 is a schematic diagram of a manufacturing process of an exemplary loofah.

In some embodiments (with or without the beads 20), a coating may be applied to the first outer layer 12 and/or the second outer layer 16 that may include one or more of a cleaning agent, a medicinal agent, an exfoliating agent, and a soap material such as a dry soaping agent to provide additional cleaning ability without the need for additional soaps. The dry soaping agent is particularly advantageous in the loofah 10 used in a single use context Referring to FIG. 4, a method of manufacturing a cotton loofah, such as the loofah 10 described above, will be described.

A manufacturing process 100 includes a roll 112 of nonwoven cotton sheet, which may already include the puffed beads 20 or the puffed beads 20 may be applied thereto. The roll 112 of nonwoven cotton becomes the first outer layer 12 of the loofah 10.

The core material, for example raw cotton, may be provided by a bale 114. The bale 114 of core material may be opened and fluffed by the machine 120 and then deposited onto the non-woven sheet material of the first outer layer 12. The core material becomes the intermediate layer 14 of the loofah 10. The opened and fluffed material may have a binder applied by the machine 122 before it is deposited on the first outer layer 12. The binder may also be sprayed onto the intermediate layer 14 after it is deposited onto the first outer layer 12.

A second roll 116 of nonwoven cotton becomes the second outer layer 16 of the loofah 10. The roll 116 of nonwoven cotton may already include the puffed beads 20 or the puffed beads 20 may be applied thereto. It will be appreciated that while two rolls of nonwoven cotton have been depicted, a single two ply roll may be used or as yet another alternative, a wide roll may be cut and the cut portions provided in the place of the two rolls of nonwoven cotton.

The first outer layer 112, the intermediate layer 114, and the second outer layer 116 may be provided to the needling/hydroentangling machine 124 to adhere the layers together. The machine 124 may pull fibers of the first outer layer 112 into the second outer layer 116 and vice versa. Bonding the exfoliating layer(s) as part of the needling or hydro entangling process may provide an efficient method of incorporating the exfoliating layers(s) with the cotton product while not requiring adhesives or bonding agents. As noted above, the combination of bonding the exfoliating layer(s) while needling or hydro entangling the cotton product may also provide significant economy. This method may also provide a way to insure the "purity" of the final product by limiting the ingredients.

The combined first outer layer 112, intermediate layer 114, and second outer layer 116 may then be provided to a cutter and stacker 126 to provide the finished loofah 10.

As an additional advantage of not requiring glues or adhesives and that all the layers of the loofah 10 may be provided from cotton, further processing steps such as providing a stitches edge are not required. Thus, the intermediate layer 114 may remain exposed at the edges of the loofah 10.

In an embodiment, the loofah 10 is provided as a four sided product, such as a square or rectangle. Preferably, the loofah 10 is about the size of a hand having sides in the range of 4-6". A four sided product having sides in the range of 4-6" can be quickly manufactured using wide format machines making the manufacture of the loofah 10 fast and efficient. While other shapes such as round and oval may be used, a four sided shape can be quickly cut and stacked with little waste. This may also increase the economy of the finished loofah 10.

While various embodiments in accordance with the disclosed principles have been described above, it should be understood that they have been presented by way of example only, and are not limiting. For example, the present disclosure is not limited to cotton products and is also applicable to other materials such as rayon, bamboo fiber, tree fiber, grass fiber and synthetic analogs of the same. Regenerated cotton products may also be used for some or all of the layers of the disclosed loofah. These alternative materials, including rayon and bamboo fiber, can each be prepared to have different water absorbencies for inner core material as compared to an outer material according the principals of the present disclosure. It will also be appreciated that the layers of the loofah may include synthetic materials blended with cotton or may also be fully synthetic. For example, the core may include other less or non-absorptive materials such as synthetic materials like polyester, polypropylene, polyethylene or combinations thereof. As another example, the outer layers may include a blend (e.g., 10%) polyester, polyethylene, or combinations thereof for lower cost.

Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

The invention claimed is:

1. A loofah, comprising:

an inner core including cotton that has at least half of its natural oils; and an outer portion including cotton, a water absorbency of the inner core being less than a water absorbency of the outer portion.

2. The loofah of claim 1, wherein the inner core includes hydro entangled or needled cotton.

3. The loofah of claim 1, wherein the inner core includes unbleached cotton.

4. The loofah of claim 3, wherein the outer portion includes bleached cotton.

5. The loofah of claim 1, wherein the outer core includes hydro entangled or needled cotton.

6. The loofah of claim 1, wherein the outer portion includes bleached cotton.

7. A loofah, comprising:

a first outer layer, a majority of a material of the first outer layer being cotton;

a second outer layer, a majority of a material of the second outer layer being cotton; and an inner layer disposed between the first outer layer and the second outer layer, a majority of a material of the inner layer being cotton that has at least half of its natural oils, wherein a water absorbency of the material of the inner layer is less than a water absorbency of the material of the first outer layer, and the water absorbency of the material of the inner layer is less than a water absorbency of the material of the second outer layer.

8. The loofah of claim 7, wherein the material of the first outer layer is hydrophilic.

9. The loofah of claim 7, wherein the material of the inner layer is hydrophobic.

10. The loofah of claim 7, wherein the material of the inner layer includes unbleached cotton.

11. The loofah of claim 10, wherein the material of the first outer layer includes bleached cotton.

12. The loofah of claim 11, wherein the material of the second outer layer includes bleached cotton.

13. The loofah of claim 7, wherein the inner layer includes a stiffening agent.

14. The loofah of claim 7, further comprising a plurality of beads adhered to the first outer layer.

15. The loofah of claim 14, wherein the beads include a puffing agent.

16. The loofah of claim 7, wherein the material of the first outer layer is entangled with the second outer layer, and the material of the second outer layer is entangled with the first outer layer.

17. The loofah of claim 16, wherein the loofah does not include an adhesive.

18. The loofah of claim 16, wherein the material of the inner layer is exposed as an outer surface of the loofah.

19. The loofah of claim 7, wherein the material of the first outer layer includes bleached cotton.

20. The loofah of claim 19, wherein the material of the second outer layer includes bleached cotton.

21. A method of manufacturing a loofah, comprising:

providing a first sheet of non-woven cotton;

depositing unbleached cotton onto the first sheet of non-woven cotton;

providing a second sheet of non-woven cotton at a side of the unbleached cotton distal to the first sheet of non-woven cotton; and entangling the first sheet of non-woven cotton, the unbleached cotton, and the second sheet of non-woven cotton, wherein a water absorbency of the unbleached cotton is less than a water absorbency of the first sheet, and the water absorbency of the unbleached cotton is less than a water absorbency of the second sheet.

22. The method of claim 21, wherein the entangling includes at least one of hydroentangling and needling.

23. The method of claim 21, further comprising applying a stiffening agent to the unbleached cotton.

24. The method of claim 21, further comprising cutting the entangled cotton to provide a plurality of loofahs.

25. The method of claim 21, further comprising providing a plurality of solid beads on at least one surface of the first or second sheets of non-woven cotton.

* * * * *